US010273825B2

(12) United States Patent
Jones et al.

(10) Patent No.: US 10,273,825 B2
(45) Date of Patent: Apr. 30, 2019

(54) WALL COOLING ARRANGEMENT FOR A GAS TURBINE ENGINE

(71) Applicant: ROLLS-ROYCE plc, London (GB)

(72) Inventors: Simon L. Jones, Bristol (GB); Mark J. Simms, Bristol (GB)

(73) Assignee: ROLLS-ROYCE plc, London (GB)

( * ) Notice: Subject to any disclaimer, the term of this patent is extended or adjusted under 35 U.S.C. 154(b) by 392 days.

(21) Appl. No.: 15/152,195

(22) Filed: May 11, 2016

(65) Prior Publication Data

US 2016/0333784 A1 Nov. 17, 2016

(30) Foreign Application Priority Data

May 15, 2015 (GB) ..... 1508323.1

(51) Int. Cl.
*F01D 11/08* (2006.01)
*F01D 25/00* (2006.01)

(52) U.S. Cl.
CPC ..... *F01D 25/005* (2013.01); *F01D 11/08* (2013.01); *F05D 2240/11* (2013.01); *F05D 2260/204* (2013.01); *F05D 2260/205* (2013.01); *F05D 2300/6033* (2013.01)

(58) Field of Classification Search
CPC ..... F01D 25/246; F05D 2240/11; F05D 2260/204; F05D 2300/6033
See application file for complete search history.

(56) References Cited

U.S. PATENT DOCUMENTS 3,583,824 A * 6/1971 Smuland ..... F01D 11/18 415/117
4,157,232 A * 6/1979 Bobo ..... F01D 11/08 415/116
5,127,793 A * 7/1992 Walker ..... F01D 11/08 415/115
5,169,287 A * 12/1992 Proctor ..... F01D 5/182 415/115
8,814,507 B1 8/2014 Campbell et al.
2009/0202337 A1 8/2009 Bosley et al.
2012/0237342 A1* 9/2012 Berche ..... F01D 11/005 415/174.1
2014/0341717 A1 11/2014 Jones et al.

OTHER PUBLICATIONS

Nov. 16, 2015 Search Report issued in British Patent Application No. 1508323.1.

* cited by examiner

*Primary Examiner* — Matthew W Jellett
(74) *Attorney, Agent, or Firm* — Oliff PLC

(57) ABSTRACT

A wall arrangement for the main gas path of a gas turbine engine, including: a wall segment which defines the main gas path, the wall segment having a gas path side, an outboard side and a support wall extending from the outboard side towards a supporting structure, and a channel member abutting the support wall and having one or more channels defined by the abutment of the support wall and channel member, the one or more channel having radially separated inlet and outlet.

16 Claims, 3 Drawing Sheets

WALL COOLING ARRANGEMENT FOR A GAS TURBINE ENGINE

TECHNICAL FIELD OF INVENTION

This invention relates to a wall arrangement for a gas turbine engine. The wall arrangement is particularly advantageous when used with a Ceramic Matrix Composite, CMC, wall segment. However, it may be used where a surface cooling of a metallic component is required.

BACKGROUND OF INVENTION

With reference to FIG. 1, a ducted fan gas turbine engine generally indicated at 10 has a principal and rotational axis X-X. The engine comprises, in axial flow series, an air intake 11, a propulsive fan 12, an intermediate pressure compressor 13, a high-pressure compressor 14, combustion equipment 15, a high-pressure turbine 16, and intermediate pressure turbine 17, a low-pressure turbine 18 and a core engine exhaust nozzle 19. A nacelle 21 generally surrounds the engine 10 and defines the intake 11, a bypass duct 22 and a bypass exhaust nozzle 23.

The gas turbine engine 10 works in a conventional manner so that air entering the intake 11 is accelerated by the fan 12 to produce two air flows: a first air flow A into the intermediate pressure compressor 13 and a second air flow B which passes through the bypass duct 22 to provide propulsive thrust. The intermediate pressure compressor 13 compresses the air flow A directed into it before delivering that air to the high pressure compressor 14 where further compression takes place.

The compressed air exhausted from the high-pressure compressor 14 is directed into the combustion equipment 15 where it is mixed with fuel and the mixture combusted. The resultant hot combustion products then expand through, and thereby drive the high, intermediate and low-pressure turbines 16, 17, 18 before being exhausted through the nozzle 19 to provide additional propulsive thrust. The high, intermediate and low-pressure turbines respectively drive the high and intermediate pressure compressors 14, 13 and the fan 12 by suitable interconnecting shafts.

The performance of gas turbine engines, whether measured in terms of efficiency or specific output, is improved by increasing the turbine gas temperature. For any engine cycle compression ratio or bypass ratio, increasing the turbine entry gas temperature produces more specific thrust (e.g. engine thrust per unit of air mass flow). It is therefore desirable to operate the turbines at the highest possible temperatures. However, as turbine entry temperatures increase, the life of a turbine generally shortens, necessitating the development of better materials and/or the introduction of improved cooling systems.

One group of improved materials includes so-called ceramic matrix composite, CMC, materials, CMCs offer superior temperature and creep resistant properties for gas turbine engines and have a considerably lower density than their superalloy counterparts making them ideal for aeroengines. Further, because they have a higher temperature tolerance, CMC materials require less cooling which acts to increase specific fuel consumption further.

CMC materials generally consist of ceramic fibres embedded with a ceramic body. There are different materials available for fibres and the body. Two of the more promising materials for gas turbine engines are silicon carbide fibres within a body of silicon carbide, so-called SiC/SiC, and aluminium oxide fibres within an aluminium oxide body, which is referred to simply as an oxide CMC. The processes for manufacturing CMC materials are reasonably well known and understood in the art.

FIG. 2 shows a high pressure turbine section of the engine shown in FIG. 1. Thus, there is shown an nozzle guide vane 212 and turbine blade 214 in flow series having aerofoil sections within the main gas path 216. The turbine blade includes a tip 218 which is radially shrouded by a seal segment 220. The seal segment 220 bounds and defines the main gas path 216 on the outboard side of the turbine core. The seal segment 220 in the example shown is manufactured from a CMC material so as to provide some of the advantages outlined above.

The seal segment 220 includes a radially inboard gas washed surface 222 with radially extending supporting walls 224 which project towards and append from the engine casing via an intermediate support structure in the form of a so-called carrier 226. The walls 224 include forward facing hooks which mate with corresponding formations on the carrier 226. The carrier 226 is attached to the engine casing 230. FIG. 2 shows a single seal segment 220 in streamwise section but it will be appreciated that this is one of many circumferentially arranged seal segments 220 configured to provide an annular wall around the turbine wheel.

Although CMC components are much improved with regard to thermal performance, there is still a requirement to cool them. However, the cooling must be done in such a way that the thermal differential across any part of the component is kept to a minimum to prevent the associated thermal strain which may lead to cracking and failure of parts.

The wall arrangement shown in FIG. 2 uses two sources of cooling air having different temperatures and pressures to provide cooling to the outboard side of the seal segment. A dual source cooling of this type promotes more efficient use of cooling air which ultimately improves the efficiency of the engine. However, internal cooling passages are difficult to manufacture and can lead to deleterious thermal stress.

The invention seeks to provide an improved cooling arrangement for a gas turbine engine.

STATEMENTS OF INVENTION

The present invention provides a wall arrangement according to the appended claims.

Described below are wall arrangements for the main gas path of a gas turbine engine, comprising: a wall segment which defines the main gas path, the wall segment having a gas path side, an outboard side and a support wall extending from the outboard side towards a supporting structure, and a channel member abutting the support wall and having one or more channels defined by the abutment of the support wall and channel member, the one or more channel having radially separated inlet and outlet.

Either or both the channel member or support wall may include at least one recess in an abutting surface thereof, the abutting surface being in contact with a corresponding surface of the support wall such that corresponding surface of the supporting wall and recess define the channel.

The recesses may be provided by a plurality of protrusions located on the abutting surface. The protrusions may be arranged to provide a separation of the upstream surface of the channel member and supporting wall when the two are in an abutting relation. The protrusions may be pedestals or ribs. The ribs may be elongate and arranged longitudinally. The recesses support wall may include one or more recesses. The support wall recesses may be in addition to or as an alternative to the channel member recesses.

The channel member is provided on a downstream side of the support wall. The inlet and outlet may be at radial extremes of the channel member.

The inlet may be located within an inlet portion which extends axially fore of the downstream supporting wall so as to radially shroud the distal end of the supporting wall. The distal end is with respect to the main gas path and principal axis of the engine.

The inlet portion may be separated from the supporting wall. The inlet portion may be inclined relative to the radially outer surface of the supporting wall so as to provide a convergent channel therebetween.

The outlet may include an outlet portion which extends axially downstream from the supporting wall. The outlet portion may abut the outboard side of the wall segment. The one or more channels may extend at least to the outlet portion. The outlet portion may terminate local to the junction between the supporting wall and outboard side of the wall segment. Alternatively, the outlet portion may extend fully to a trailing edge portion of the wall segment. The outlet portion may include a one more outlets apertures corresponding to the one or more channels. The one or more outlet apertures may be located in a flow alignment with a downstream component so as to provide a cooling flow thereto.

The support wall may fluidically partition a space outboard of the wall segment to provide an upstream and a downstream chamber. The channel member inlet may be provided in fluid communication with the upstream chamber. The outlet is in fluid communication with the downstream chamber. The upstream and downstream chamber may provide a holding space for cooling air. The cooling air may have different operating temperatures and pressures in the upstream and downstream chambers. The upstream chamber may include air of a higher pressure than the downstream chamber.

The wall segment may comprise a CMC material.

The wall arrangement may further comprise a carrier which provides radial support for the wall segment. The engine casing may include at least one appendage in an abutting relation with the wall segment. The at least one appendage may be provided on a downstream side so as to provide axial retention of the wall segment.

The at least one appendage may be a protrusion or projection extending from the engine casing. The protrusion or projection may be a flange or lug. The appendage may engage with the carrier to provide additional axial retention thereof.

The channel member may be sandwiched between the appendage of the engine casing and the supporting wall.

The wall segment may be attached to a carrier structure. The carrier may be attached to an engine casing via an intermediate attachment.

The carrier may include a metering through-hole local to the inlet of the channel member.

Within the scope of this application it is expressly envisaged that the various aspects, embodiments, examples and alternatives, and in particular the individual features thereof, set out in the preceding paragraphs, in the claims and/or in the following description and drawings, may be taken independently or in any combination. For example features described in connection with one embodiment are applicable to all embodiments, unless such features are incompatible.

DESCRIPTION OF DRAWINGS

Embodiments of the invention will now be described with the aid of the following drawings of which.

DETAILED DESCRIPTION OF INVENTION

Figure 1:
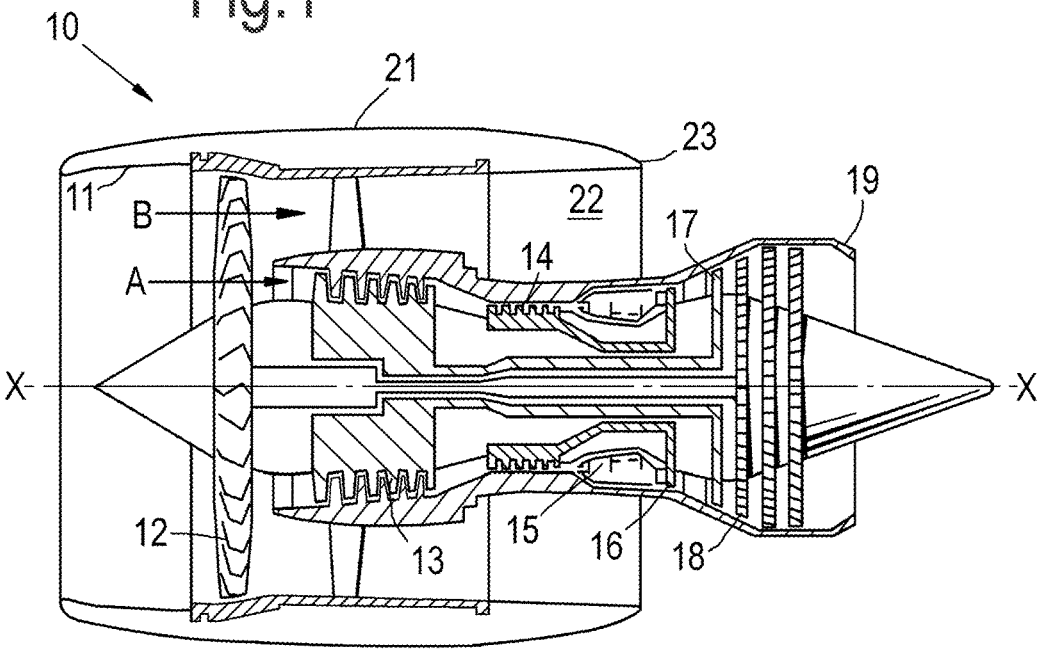
FIG. 1 shows a streamwise sectional view of a gas turbine engine.
Figure 2:
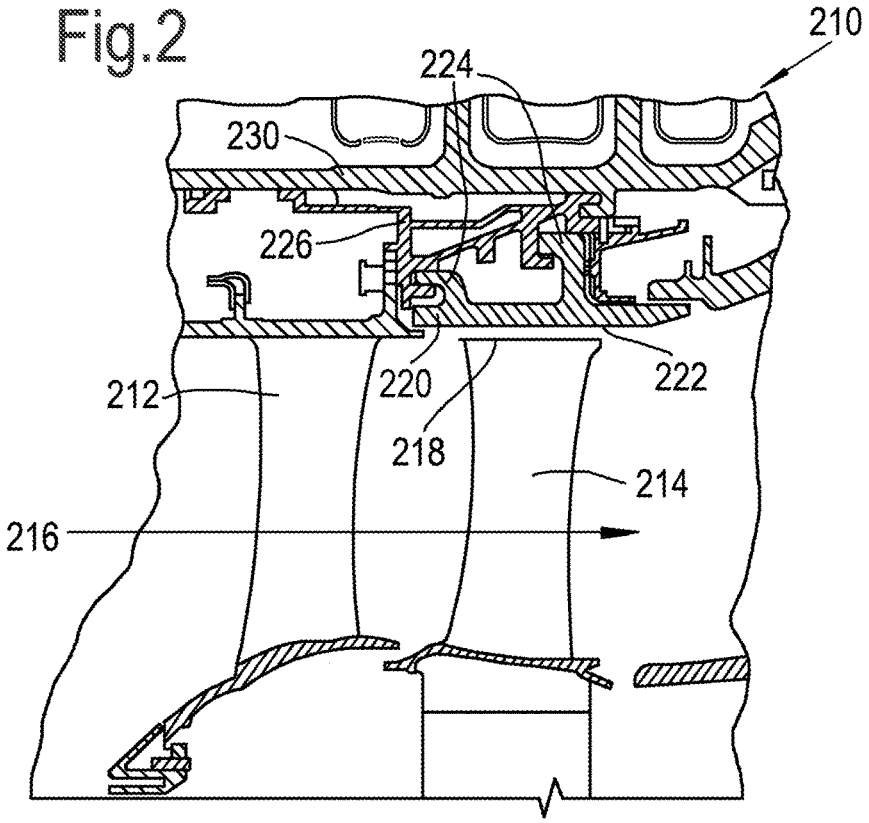
FIG. 2 shows a streamwise sectional view of a turbine stage of a gas turbine which includes a CMC seal segment.
Figure 3:
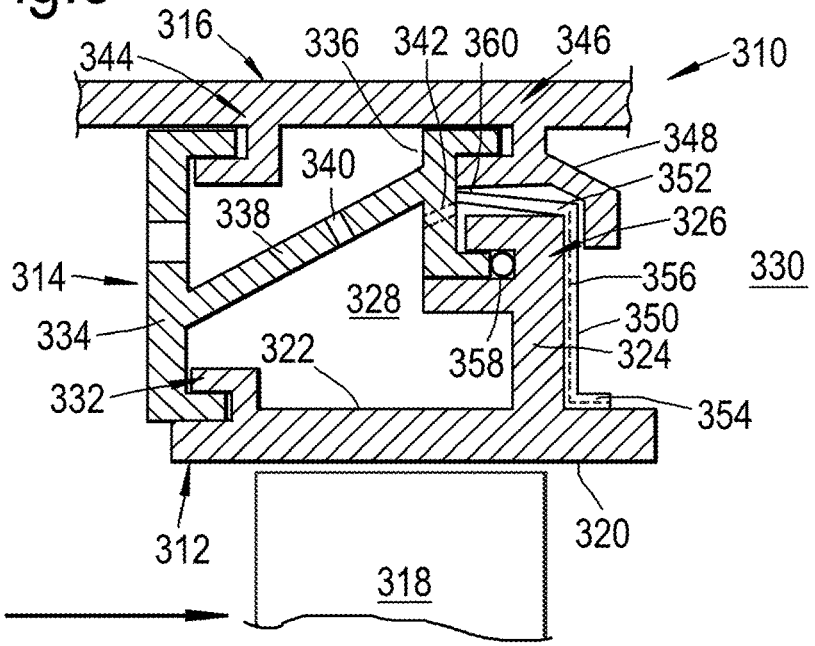
FIG. 3 shows a schematic view of a first alternative CMC segment.

Thus, FIG. 3 provides a wall arrangement 310 for a gas turbine engine. The wall arrangement 310 includes a wall segment 312 in the form of a seal segment, a carrier 314 and an engine casing 316. The wall segment 312 defines and bounds the main gas path on the outboard side of a turbine blade 318 and as such has a gas path side 320, and an outboard side 322. It will be appreciated that the wall arrangement 310 is one of a plurality of circumferentially adjacent segments which form an annulus around the turbine blades as is well known in the art.

The wall segment 312 includes a supporting wall 324 which extends from the outboard side in a generally radial direction towards the engine casing 316. The supporting wall 324 includes a birdsmouth or hook 326 at a distal end thereof which receives a corresponding feature of the carrier. The supporting wall 324 fluidically partitions the space outboard of the wall segment 312 to provide upstream and downstream chambers 328, 330. In use, the upstream and downstream chambers are provided with cooling air of different relative pressures.

The supporting wall 324 is located in the axial downstream half of the wall segment 312. A fore hook 332 is provided towards an upstream edge of the wall segment 312. The fore hook 332 receives a corresponding feature of the carrier. Both the fore hook 332 and the supporting wall hook 326 are forward facing so as to receive the carrier from an upstream direction.

The carrier 314 provides an intermediate support between the engine casing 316 and wall segment 312. The carrier 314 includes an upstream wall 334 and a downstream wall 336 which engage with the fore hook 332 and supporting wall hook 326 of the wall segment 312. The outboard end of the upstream 334 and downstream 336 walls include further hook features which attach to corresponding engagements on the engine casing 316. The downstream carrier hook attachment provides a circumferential slot which receives the hook 326 of the wall segment 312 and that of the engine casing 316 in a radially adjacent and separated relation.

A bracing wall 338 extends between the upstream 334 and downstream 336 walls of the carrier 314 in an axial and radial direction so as to react the axial loading of the wall segment 312 to the downstream engine casing attachment. The bracing wall includes one or more metering holes 340 which governs the pressure in the upstream chamber 328.

The downstream wall 336 of the carrier includes one or more through-holes 342 to fluidically connect the upstream 328 and downstream 330 chambers. In use, the through-hole 342 provides a metered amount of cooling air from chamber 328 down the back of the support wall 324 and wall segment 312 and exhausts it in a downstream direction and towards the trailing edge of the wall segment. The arrangement is configured to maintain a pressure bulkhead seal between the upstream and downstream chambers 328 and 330.

The through-hole 342 includes an inlet and outlet. The outlet is positioned radially outboard of the wall segment supporting arm so as to pass air over the supporting wall 324 without the need of a further through-hole in the supporting wall 324.

The engine casing 316 is a substantially tubular member and provides support and containment for the turbine. The engine casing includes fore 344 and aft 346 hooks which engage with and support the carrier 314. The aft hook 346 includes an axial restriant in the form of a lug or flange 348 which extends axially downstream and radially inwards. The flange 348 resides on the downstream side of the wall segment 312 supporting wall 324. A first end of the flange 348 is attached to the engine casing at a common location to the aft hook 346, however, the flange may attach to the engine casing separately to the carrier support features.

Thus, the engine casing provides direct axial restraint of the wall segment 316 and carrier 314. The direct axial restraint is provided by an abutting contact with an integral appendage of the engine casing. The appendage may be provided by the hook or flange described above and shown in FIG. 3, or may be an alternative protrusion.

Figure 5:
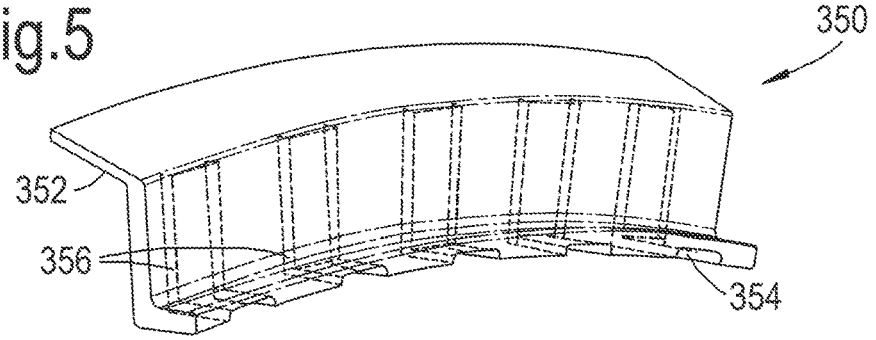
FIG. 5 shows an inclined upstream perspective view of the channel member of FIG. 3.

A channel member 350 (additionally shown in FIG. 5) is located on the downstream side of the wall segment supporting wall 324. The channel member 350 is adjacent to and abuts the downstream side of the supporting wall 324 and extends in radial and circumferential directions to cover the extent of the supporting wall 324, the interface between the two being provided by corresponding respective abutting surfaces.

The channel member 350 includes axially extending inlet 352 and outlet 354 portions. The inlet portion 352 is outboard of the supporting wall 326 and extends in a generally upstream axial direction so as to pass over the wall segment hook, thereby shrouding it. The inlet portion 352 extends forward from the downstream side of the supporting wall 326 towards the carrier 314. Thus, a first end of the channel member 350 is proximate to a wall of the carrier 314; potentially abutting the carrier wall 314 under some load conditions. The outlet portion 354 is located proximate to the outboard side 322 of the wall segment 312 and extends in a generally downstream direction.

The channel member 350 includes a plurality of recesses 356 in a surface thereof. The recesses 356 are elongate and extend radially inwards from the inlet portion 352 to the outlet portion 354 thereof. The recesses 356 are thus provided by radially extending walls which partition the abutting surface into a plurality of circumferentially separated discrete flow channels which are substantially rectangular in lateral section. It will be appreciated, that channel shapes other than rectangular, may be beneficial for managing the flow of cooling air therein. Further, the surfaces of the channel member 350 and/or wall segment 312 may include surface features to promote cooling. Such features may include strips or pedestals as well known in the art of turbine cooling.

The channels and recesses may be provided by a plurality of protrusions located on the abutting surface. The protrusions would act to provide a separation and spacing of the upstream surface of the channel member 350 and supporting wall 326 when the two are in an abutting relation. Hence, the recesses may be provided by a general separation of the flow passage walls and may include a plurality of interconnected generally parallel flow paths. The protrusions may be pedestals or ribs. The ribs may be elongate and arranged longitudinally parallel relation. It will be appreciated that such features may also be preferentially arranged to enhance heat transfer between the cooling air flow and components.

The recesses 356 are provided in the upstream surface of the channel member 350 which is proximate to and abuts the corresponding opposing surface of the support wall 324. Thus, the recesses 356 and supporting wall define a channel in unison.

The channel extends from the inlet portion 352 to the outlet portion 354 to provide a fluid communication between the two. Hence, the fluid communication provides a metered flow of cooling air from an upstream high pressure chamber to a downstream lower pressure chamber.

It will be appreciated that in some examples, the support wall 324 may provide the recesses for a cooling flow. In this instance, the channel member 350 may include a planar surface to enclose the channel, or include a further recess to supplement the over flow area.

The inlet portion includes an axially extending wall which extends radially upstream over the distal end of the supporting wall so as to shroud it. The inlet portion wall is inclined relative to the radially outer surface of the supporting wall such that the separating gap is in the form of a convergent channel upstream of the inlet, the inlet being provided at the junction of the supporting wall surface and abutting surface of the channel member.

The radially inner end of the channel member 350 terminates in an axially extending wall portion which abuts the outboard side of the wall segment, thereby providing an outlet portion. The outlet portion includes recesses in the abutting surface thereof which combine with the outboard side to provide the flow channels in a similar fashion to the supporting wall described above.

The exhausting flow may be used to cool an upstream edge or portion of a downstream component such as the adjacent nozzle guide vane platform which may be made from a metallic material and require a greater degree of cooling. Thus, the outlet portion which is located proximate to or abutting the radial outboard side of the wall segment 312 may extend to a greater or lesser extent than that shown in FIG. 3. The outlet portion may extend fully to a trailing edge portion of the wall segment.

The channel member 350 is sandwiched between the axially restraining flange of the engine casing.

The carrier 314 and wall segment 312 hook include a seal therebetween in the form of a rope seal 358. The rope seal 358 provides a more predictable seal under operating conditions which results in a more accurate metering of cooling air from through-hole 342 The wall segment 312 of the described example is made from a CMC material as known in the art. However, it will be appreciated that the wall surface cooling arrangement provided by the invention may find utilisation for walls constructed from alternative materials, such as metal as is well known in the art for gas turbines.

The channel member 350 may be constructed from any suitable material known in the art. Thus, the channel member may, for example, be made from the same material as the carrier or the wall segment.

It will be appreciated that the channel member will generally form a full annulus around principal axis of the engine when assembly, but will typically be made up from numerous segments. The circumferential extent of the segments may match that of the wall segment 314, or by a multiple thereof. For example, the channel member 350 may be twice the arcuate length of the wall segment and carrier which are formed as a cassette prior to attachment to the engine casing.

In use, cooling air of a first pressure is provided in the upstream chamber and cooling air of a second pressure on the downstream side. The two sources of cooling air will typically be provided by separate stages of a compressor. The cooling air provided to the upstream chamber 328 enters through one or more inlets 360 located in the upstream wall. The metered air flow is then provided to the radially inner sub-chamber before passing through the downstream wall of the carrier 314 via the inlet through-hole which is local to the inlet of the channel member 350.

Figure 4:
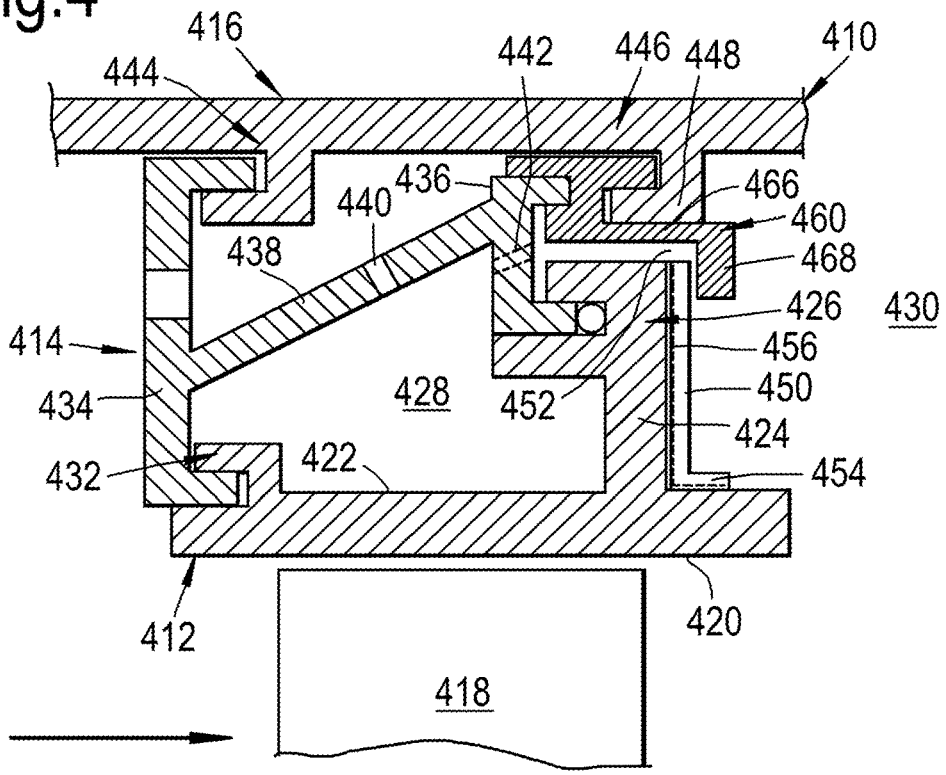
FIG. 4 shows a schematic view of a second alternative CMC segment.

FIG. 4 shows an alternative wall arrangement 410. The wall arrangement 410 is similar in many respects to that of FIG. 3 with some specific differences highlighted below. Thus, the description of features in FIG. 3, may be attributed to FIG. 4 where appropriate.

FIG. 4 shows a wall arrangement 410 which includes a wall segment 412, a carrier 414 and an engine casing 416. The wall segment 412 defines and bounds the main gas path on the outboard side of a turbine blade 418 and as such has a gas path side 420, and an outboard side 422. It will be appreciated that the wall arrangement 410 is one of a plurality of circumferentially adjacent segments which form an annulus around the turbine blades as is well known in the art.

The wall segment 412 includes a supporting wall 424 which extends from the outboard side in a generally radial direction towards the engine casing 416. The supporting wall 424 includes a birdsmouth or hook 426 at a distal end thereof which receives a corresponding feature of the carrier. The supporting wall 424 fluidically partitions the space outboard of the wall segment 412 to provide upstream and downstream chambers 428, 430. In use, the upstream and downstream chambers are provided with cooling air of different relative pressures to provide cooling to the wall segment 412.

The supporting wall 424 is axially located in the downstream half of the wall segment 412. A fore hook 432 is provided towards an upstream edge of the wall segment 412 and a corresponding feature of the carrier 414. Both the fore hook 434 and the supporting wall hook 426 are forward facing so as to receive the carrier hooks from an upstream direction.

The carrier 414 provides an intermediate support between the engine casing 416 and wall segment 412. The carrier 414 includes an upstream wall 434 and a downstream wall 436 which engage with the fore hook 432 and supporting wall hook 436 of the wall segment 412. The outboard end of the upstream 434 and downstream 436 walls include further hook features which attach to corresponding engagements on the engine casing 416. A bracing wall 438 extends between the upstream 434 and downstream 436 walls of the carrier 414 with an axial and radial inclination so as to react the axial loading of the wall segment to the downstream engine casing attachment. Thus, the bracing wall extends from a radially inner upstream location to a radially outer downstream location adjacent the downstream hook 436.

The downstream wall 436 of the carrier 414 includes one or more through-holes 442 to fluidically connect the upstream 428 and downstream 430 chambers. The through-hole 442 includes an inlet and outlet. The outlet is positioned radially outboard of the wall segment supporting wall 424 so as to pass air over the radially distal end of the supporting wall 424.

The engine casing 416 is a substantially tubular housing which provides support and containment for the turbine. The engine casing 416 includes fore 444 and aft 446 hooks which engage with and support the carrier 414. The aft hook 446 includes an axial restriant in the form of a lug or flange 448 which extends axially downstream and radially inwards. The flange 448 resides on the downstream side of the wall segment 412 supporting wall 424. A first end of the flange 448 is attached to the engine casing at a common location to the aft hook 446, however, the flange 448 may attach to the engine casing 416 separate to the carrier support features in some examples.

Figure 6A:
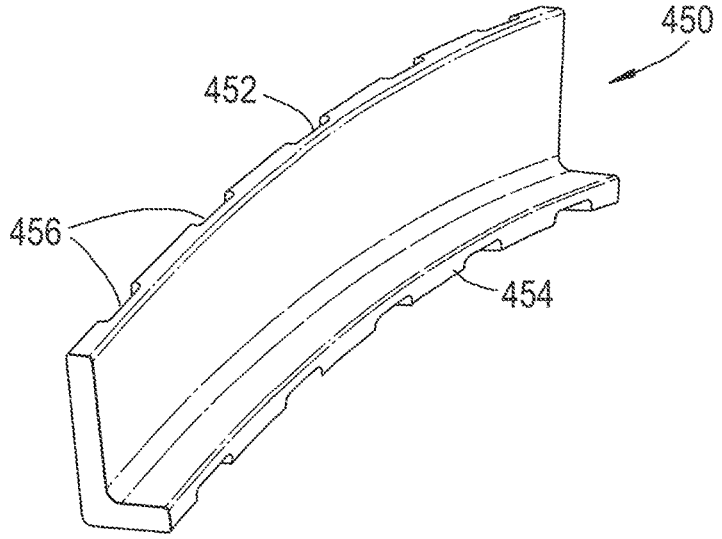
FIGS. 6*a* and 6*b* show respective inclined upstream and downstream perspective views of the channel member of FIG. 4.
Figure 6B:
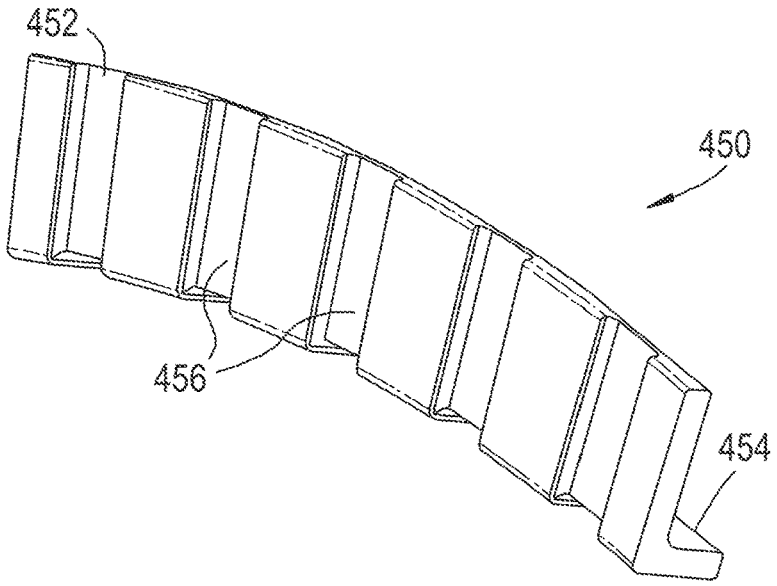

A channel member 450 (additionally shown in FIGS. 6*a* and 6*b*) is located on the downstream side of the wall segment supporting wall 424. The channel member 450 is adjacent to and abuts the downstream side of the supporting wall 424 and extends in a radial and circumferential direction to cover the extent of the supporting wall 424. The channel member 450 includes an inlet 452 towards at the radially outboard end, and an axially extending outlet 454 portion. The inlet 452 is located adjacent the distal end of the supporting wall 424 by the supporting wall 424. The outlet portion 454 is located proximate to the outboard side 422 of the wall segment 412 and extends in a generally downstream direction. Thus, in the streamwise section of FIG. 4, the channel member includes is generally L-shaped.

The channel member 450 includes a plurality of recesses 456 in a surface thereof. The recesses 456 are elongate and extend radially from the inlet portion 452 to the outlet portion 454. The recesses 456 are substantially rectangular in lateral section. As with the previously described example, it will be appreciated that other channel shapes may be beneficial for managing the flow of cooling air therein, and the surfaces of the channel member 450, or wall segment 412 may include surface features to promote cooling.

The recesses 456 are provided in the upstream surface of the channel member 450 which is proximate to and abuts the corresponding opposing surface of the support wall 424. Thus, the recesses 456 and supporting wall define a channel in unison. The channel extends from the inlet portion 452 to the outlet portion 454 to provide a fluid communication between the two.

It will be appreciated that in some examples, the support wall 424 may provide the recesses for a cooling flow. In this instance, the channel member 450 may include a planar surface to enclose the channel, or include a further recess to supplement the over flow area.

The channel member is sandwiched between the axially restraining flange of the engine casing.

The wall arrangement 410 shown in FIG. 4 includes an additional or intermediate support structure 460 which resides between engine casing 416 and carrier 414. The intermediate support 460 includes fore and aft facing hooks which engage with corresponding carrier 414 and engine casing 416 hooks, respectively.

The intermediate member 460 provides an axial retention feature in the form of an axially extending wall portion 466 and radial flange 468 which provides an axial restraint face. The axially extending wall portion 466 which partially defines the hook feature which engages with the engine casing hook. An end of the axially extending wall portion terminates in a radial flange which falls downstream of and provides axial retention face for the wall segment, via the channel member.

It will be appreciated that although the examples above show forward facing hooks, the channel members may be placed on an upstream side of the supporting wall where rearward facing hooks are used.

It will be understood that the invention is not limited to the described examples and embodiments and various modifications and improvements can be made without departing from the concepts described herein and the scope of the claims. Except where mutually exclusive, any of the features may be employed separately or in combination with any other features and the disclosure extends to and includes all combinations and sub-combinations of one or more described features.

The invention claimed is:

1. A wall arrangement for a main gas path of a gas turbine engine, the wall arrangement comprising:

a unitary wall segment defining a boundary of the main gas path, the wall segment having a gas path side and an outboard side, the wall segment including a support wall extending and projecting from the outboard side of the wall segment towards a supporting structure in a radial direction of the wall arrangement; and a channel member abutting the support wall, the channel member having at least one channel defined by the abutment of the support wall and channel member, the at least one channel having a radially separated inlet and outlet, the channel member including at least one recess recessed in an abutting surface of the channel member, the at least one recess extending from the inlet of the channel member to the outlet of the channel member in the radial direction, the abutting surface being in contact with a corresponding surface of the support wall such that the at least one channel is formed by the at least one recess located between a corresponding surface of the supporting wall and the abutting surface of the channel member.

2. The wall arrangement as claimed in claim 1, wherein the channel member is provided on a downstream side of the support wall.

3. The wall arrangement as claimed in claim 1, wherein the inlet and the outlet are at radial extremes of the channel member.

4. The wall arrangement as claimed in claim 2, wherein the inlet is located within an inlet portion extending axially forward of the downstream side of the support wall so as to radially shroud a distal end of the support wall.

5. The wall arrangement as claimed in claim 4, wherein the inlet portion is separated from the support wall.

6. The wall arrangement as claimed in claim 5, wherein the inlet portion is inclined relative to a radially outer surface of the support wall so as to provide a convergent channel there between.

7. The wall arrangement as claimed in claim 1, wherein the outlet includes an outlet portion extending axially downstream from the support wall.

8. The wall arrangement as claim in claim 7, wherein the outlet portion abuts the outboard side of the wall segment.

9. The wall arrangement as claimed in claim 1, wherein:

the support wall fluidically partitions a space outboard of the wall segment to provide an upstream chamber and a downstream chamber, and the inlet of the channel member is provided in fluid communication with the upstream chamber, and the outlet of the channel member is in fluid communication with the downstream chamber.

10. The wall arrangement as claimed in claim 1, wherein the wall segment includes a CMC material.

11. The wall arrangement as claimed in claim 10, further comprising a carrier providing radial support for the wall segment, wherein an engine casing of the gas turbine engine includes at least one appendage in an abutting relation with the wall segment, the at least one appendage being located on a downstream side of the engine casing so as to provide axial retention of the wall segment.

12. The wall arrangement as claimed in claim 11, the channel member is sandwiched between the at least one appendage of the engine casing and the support wall.

13. The wall arrangement as claimed in claim 12, wherein wall segment is attached to a carrier structure, and the carrier is attached to the engine casing via an intermediate attachment.

14. The wall arrangement as claimed in claim 13, wherein the intermediate attachment includes an axial retention feature which abuts the wall segment.

15. The wall arrangement as claimed in claim 11, wherein the carrier includes a metering through-hole connecting an upstream chamber to a downstream chamber.

16. The wall arrangement as claimed in claim 1, wherein the outlet is located on the outboard side.

* * * * *